United States Patent [19]

Yokota

[11] Patent Number: 4,782,371

[45] Date of Patent: Nov. 1, 1988

[54] DOUBLE IMAGE RECORDING METHOD

[75] Inventor: Takashi Yokota, Tokyo, Japan

[73] Assignee: Ricoh Company, Ltd., Tokyo, Japan

[21] Appl. No.: 118,545

[22] Filed: Nov. 9, 1987

[30] Foreign Application Priority Data

Nov. 10, 1986 [JP] Japan ..... 61-267403

[51] Int. Cl.[4] ..... G03G 15/00

[52] U.S. Cl. ..... 355/77; 355/8; 355/55

[58] Field of Search ..... 355/3 R, 14 R, 8, 77, 355/55, 56, 14 SH

[56] References Cited

U.S. PATENT DOCUMENTS 4,129,377 12/1978 Miyamoto et al. ..... 355/14 SH
4,417,806 11/1983 Tani et al. ..... 355/8 X
4,451,136 5/1984 Tanioka et al. ..... 355/14 SH
4,461,564 7/1984 Ikenone ..... 355/14 SH X
4,533,233 8/1985 Kimura et al. ..... 355/8
4,710,018 12/1987 Miyaji ..... 355/8

*Primary Examiner*—A. C. Prescott
*Attorney, Agent, or Firm*—Cooper & Dunham

[57] ABSTRACT

When images are repeatedly recorded on a recording medium such as a single sheet of paper, the length of the second image to be recorded is varied dependent on the shrinkage factor of the recording medium which is derived from the period of time in which the recording medium is left from the time when the recording of the first image is completed to the time when the second image starts to be recorded. Positional deviation or size difference between the images which would otherwise be caused by the shrinkage of the recording medium upon repetitive image recording can be eliminated.

2 Claims, 4 Drawing Sheets

DOUBLE IMAGE RECORDING METHOD

BACKGROUND OF THE INVENTION

The present invention relates to a double image recording method, and more particularly to a method of recording an image on a recording medium at one surface thereof in overlapping relation to an existing image previously recorded thereon or at the reverse side of the recorded surface.

Some recording apparatus such as a laser printer or a digital copier employing a CCD (charge-coupled device) operate according to the electrophotographic process. In such recording apparatus, generally, a developed image is transferred to a recording medium such as a sheet of paper, and then fixed to the recording medium. The image is fixed by a fixing device of the heating type wherein the image is thermally fused to the sheet, which is thereafter discharged as a copy out of the recording apparatus.

In recent years, images are copied in various different ways. For example, different images are copied on the opposite surfaces of one sheet of paper. According to another example, an image is formed on one surface of a sheet of paper, and another image is inset in a space in the previous image. To perform such a copying mode, a sheet of paper to which an image has been fixed is introduced again into the recording apparatus in which another image is recorded on the sheet.

When an image is fixed with heat to a recording medium such as a sheet of paper, the recording medium is caused to shrink because the moisture thereof is evaporated by the heat. Therefore, another image subsequently recorded on the sheet of paper in overlapping relation to the previous image may be shifted out of registry therewith since they are recorded at different magnification ratios.

It is known that such a phenomenon arises out of the relationship between time for which the sheet is left after an image has been fixed thereto and a sheet shrinkage factor, as indicated by the solid-line curve in FIG. 5 of the accompanying drawings.

FIG. 6 shows a process for recording images on both surfaces of a single sheet of paper. After a first image has been recorded on one surface of the sheet at (1), it is fixed with heat and, immediately thereafter, the sheet shrinks because the moisture content thereof is reduced at (2). Then, a second image is recorded on the other surface of the sheet at (3), and thereafter fixed thereto. While the sheet is being left, the sheet restores its original size by absorbing humidity at (4). However, the first and second images are of different sizes, the difference being commensurate with the shrinkage and expansion of the sheet. During the recording process, the sheet shrinks and expands as indicated by the arrows in FIG. 3.

SUMMARY OF THE INVENTION

In view of the aforesaid difficulty with the conventional double image recording method, it is an object of the present invention to provide a double image recording method capable of compensating for a positional deviation between first and second images and a difference between magnification ratios of such images.

According to the present invention, there is provided a method of recording double images on a recording medium by recording a first image on the recording medium and then recording a second image on the recording medium with main scanning means for scanning the recording medium in a first direction transverse to a second direction in which the recording medium is moved, and sub-scanning means for moving the recording medium in the second direction, the method comprising the step of varying an image magnification dependent on the magnification of an optical system, a main scanning clock signal, and the speed of movement of the main scanning means, or an image magnification dependent on a sub-scanning clock signal and the speed of movement of the sub-scanning means, or both of the image magnifications between the first and second images. More specifically, the length of the second image is varied dependent on the period of time in which the recording medium is left from the time when the recording medium with the first image recorded thereon is discharged to the time when the recording image is re-fed for recording the second image thereon.

Since the image magnifications in main scanning and sub-scanning cycles can be corrected on the basis of shrinkage and expansion of the recording medium, such as a sheet of paper, when the second image is to be recorded on the recording medium, positional deviation or size difference between the first and second images can be eliminated.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

A double image recording method according to the present invention is particularly useful when employed in a laser printer scanning system including a polygonal mirror for exposing a photosensitive body to an image to be recorded.

The basic idea of the present invention will first be described prior to describing embodiments of the present invention.

Figure 5:
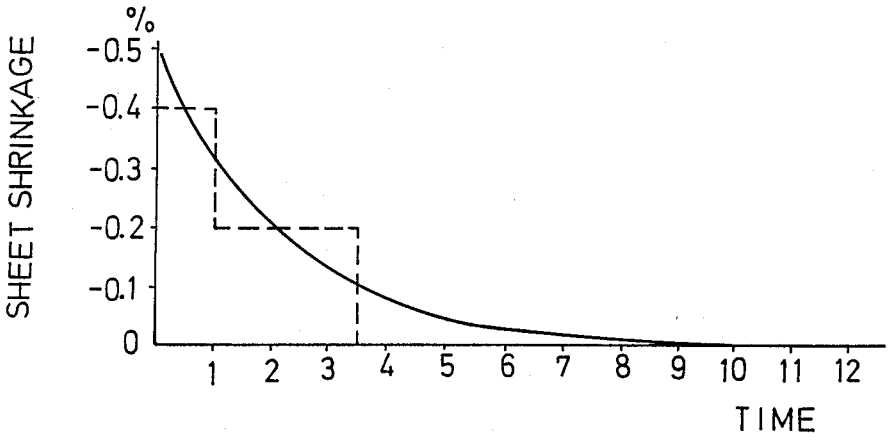
FIG. 5 is a graph showing the relationship between time in which a sheet of paper to which an image has been fixed is left and a sheet shrinkage factor.
Figure 6:
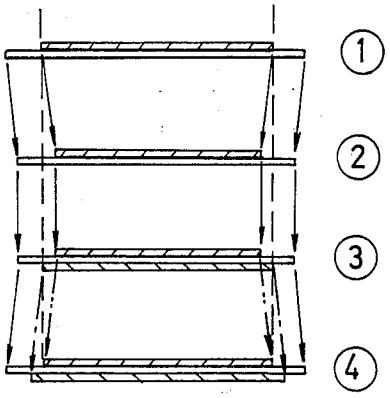
FIG. 6 is a view showing a process in which two images are recorded on one sheet of paper.

After a sheet of ordinary paper has passed through an image fixing unit, it shrinks or varies in length with time as indicated by the solid-line curve in FIG. 5. Immediately after the sheet has passed through the image fixed unit, it shrinks about 0.5%. The sheet size gradually approaches its original size as time goes on, and substantially restores its original size after about 10 minutes.

In view of the aforesaid fact that the sheet length varies with time in which it is left after image fixation, the length of an image to be recorded is corrected as indicated by the broken line in FIG. 5 so that the shrinkage factor of the image will be reduced to 0.1% or less. The shrinkage factor of the image is selected such that it is - 0.4% for the period of time ranging from 0 to 1 minute in which the sheet is left, - 0.2% for the period of time ranging from 1 to 3.5 minutes in which the sheet is left, and 0% (equal size) for the period of time over 3.5 minutes in which the sheet is left.

Figure 1:
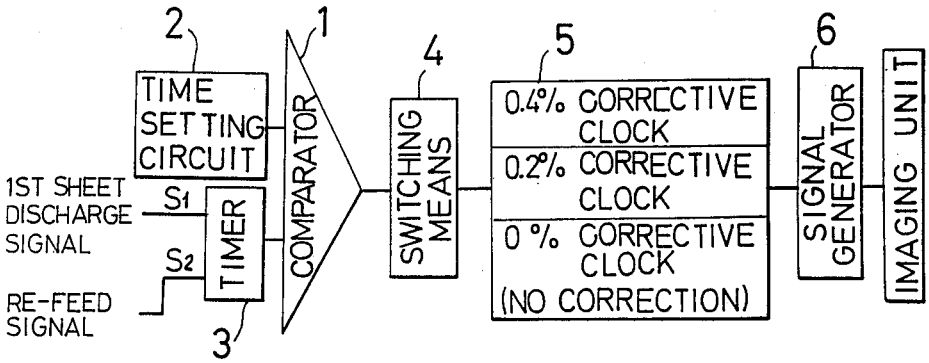
FIG. 1 is a block diagram of a circuit used for carrying out a method according to an embodiment of the present invention.

FIG. 1 shows in block form a basic circuit arrangement for carrying out a method of the present invention. A time setting circuit 2 and a timer 3 are connected to a comparator 1. The time setting circuit 2 is supplied with a preset constant or a time period. The timer 3 is supplied with a first sheet discharge signal S1 and a sheet re-feed signal S2 when starting to record a second image, and is triggered by these signals to calculate the period of time in which the sheet is to be left.

The comparator 1 is connected to switching means 4 having switching elements such as transistors. To the switching means 4, there is connected a clock generator 5 for generating a video signal to control the timing for generating a laser beam or for modulating the laser beam. The clock generator 5 is connected to a signal generator 6.

The clock generator 5 serves to correct a clock signal, for example, corresponding to the video signal. More specifically, when reducing the size of an image, the ratio at which the frequency of a clock signal is divided is varied dependent on the amount of sheet shrinkage so that a clock signal per pixel for main scanning is shortened, and a time interval for one sub-scanning cycle is shortened.

Since the image length is corrected as indicated by the broken line in FIG. 5, the clock generator 5 stores the number of steps of correcting the image length.

In response to a signal from the clock generator 5, the signal generator 6 controls operation of a main scanning signal generator or a sub-scanning signal generator in an imaging unit.

In operation, the interval of time in which the sheet of paper is to be left is detected or calculated by the timer 3 which is triggered by the first sheet discharge signal S1 and the second sheet feed signal S2, and the detected time interval is compared with the constant or time set in the time setting circuit 2. A mode signal for indicating which correction mode is to be selected is applied to the clock generator 5. More specifically, the switching means 4 establishes a switching mode for the clock generator 5 in order to change the image length in the imaging unit in response to a mode signal.

Therefore, the imaging unit effects the main scanning cycle and the sub-scanning cycle with a corrected control signal for the main scanning cycle or a corrected control signal for the sub-scanning cycle or both.

Figure 2:
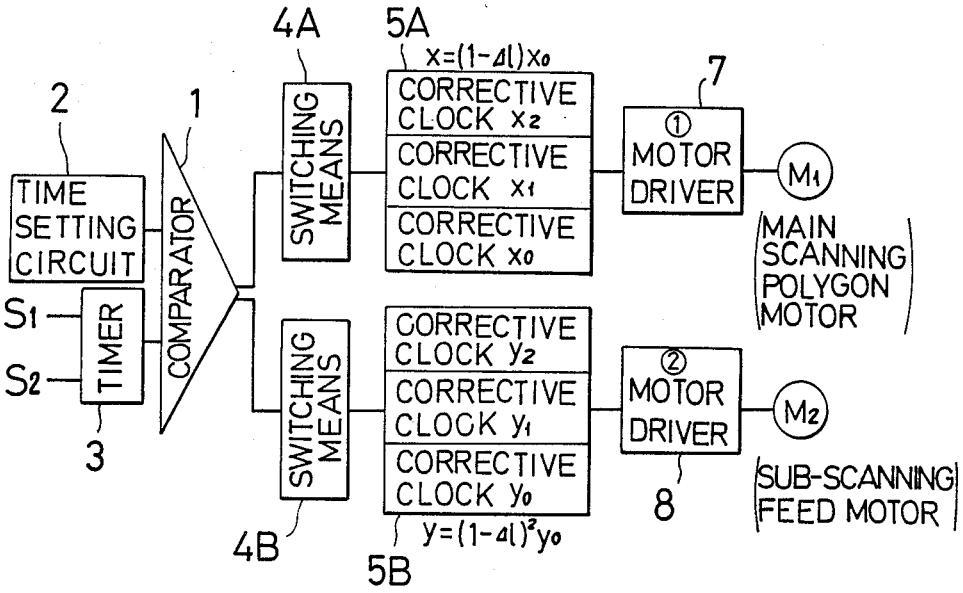
FIG. 2 is a block diagram of a circuit used for carrying out a method according to another embodiment of the present invention.
Figure 3:
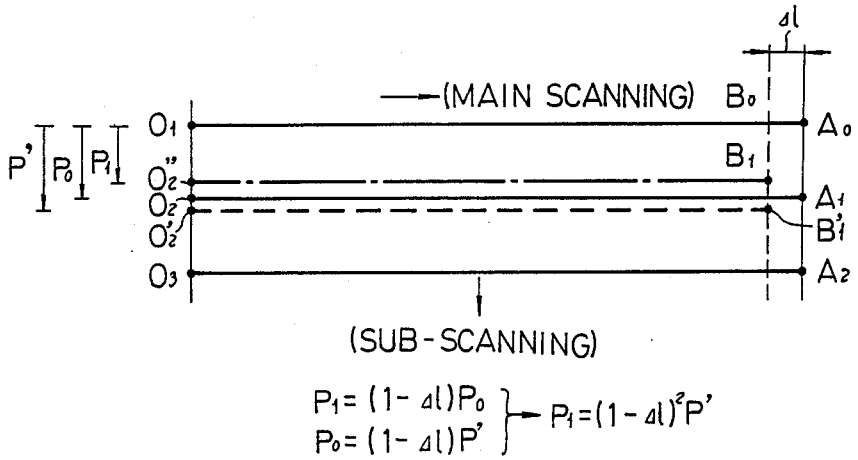
FIG. 3 is a diagram explaining the principles behind the circuit arrangement shown in FIG. 2.

FIG. 2 shows a circuit arrangement for performing a method according to another embodiment of the present invention. In the embodiment shown in FIG. 2, a clock signal corresponding to a video signal remains unchanged, but the speeds of rotation of scanning motors are varied to vary the magnification ratio of an image.

Figure 7:
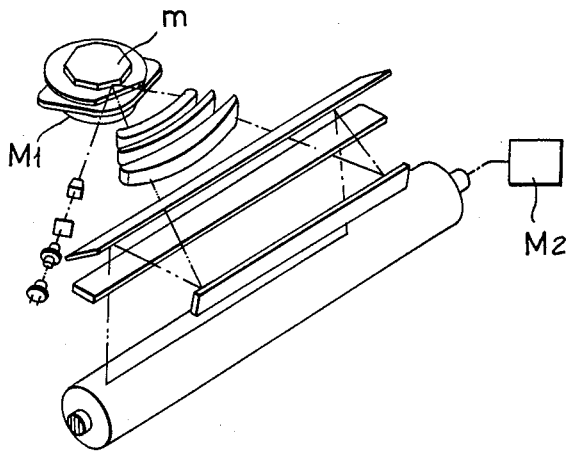
FIG. 7 is a perspective view of a scanning system of a laser printer.

Generally in a laser printer, as shown in FIG. 7, a main scanning process is effected by rotatable deflecting means such as a polygonal mirror M directly coupled to a motor M1, and a sub-scanning process is effected by a feed motor M2 for feeding a photosensitive body or a sheet of recording paper. Drive clock signals in systems for controlling the speeds of rotation of these motors are therefore varied.

The output signal from a comparator 1 is applied to two switching means 4A, 4B which are coupled respectively to a main scanning clock generator 5A and a sub-scanning clock generator 5B. These clock generators 5A, 5B are connected via respective motor drivers 7, 8 to respective motors M1, M2 for driving the main scanning polygonal mirror and feeding the sheet of paper or the like, respectively.

The clock signal for driving the motor Ml is corrected according to $(1-\Delta l)xo$, whereas the clock signal for driving the motor M2 is corrected according to $(1-\Delta l)^2yo$, where $\Delta l$ is indicative of the ratio of the amount of sheet shrinkage. The ratio $\Delta l$ is 0.004 when the amount of sheet shrinkage is 0.4%. xo and yo represent the clock frequencies when the sheet is passed at first.

The reasons for the above corrected values are as follows:

It is assumed that main scanning cycles are effected from O1 to A0, O2 to A1, O3 to A2 for a first image. If only the motor Ml for driving the polygonal mirror is controlled to scan the sheet with a delay $\Delta l$ without varying the clock signal for the sub-scanning sheet feed motor M2, the main scanning cycles are effected from O1 to B0, O2' to B1'. The sub-scanning pitch at this time is increased an amount of P' which is commensurate with the delay $\Delta l$. Thus, $P'=1/(1-\Delta l)P0$, and hence $P0=(1-\Delta l)P'$.

If the sub-scanning feed motor M2 is delayed without varying the clock signal for the motor M1, then $P1=(1-)P0$. It can be derived from the above two equations: $P1=(1-l)P0$ and $P0=(1-\Delta l)P'$ that $P1=(1-\Delta l)^2 P'$. In order to delay the main scanning cycles by $\Delta l$ and shorten the sub-scanning cycle by $\Delta l$, therefore, it is necessary to delay the sub-scanning feed motor M2 at the rate of the square of the difference between $\Delta l$ and a prescribed image density.

Stated otherwise, an image is recorded on a sheet based on a desired image density according to main scanning and sub-scanning cycles. If the sheet varies in size due to shrinkage thereof, and when a second image is to be recorded on the sheet at the desired image density according to main scanning and sub-scanning cycles, the ratio of the main scanning and sub-scanning cycles is varied in order to meet the desired image density and obtain the same image size since no equal image size would be attained if the ratio of the main scanning and subscanning cycles were varied for recording the second image.

Figure 4:
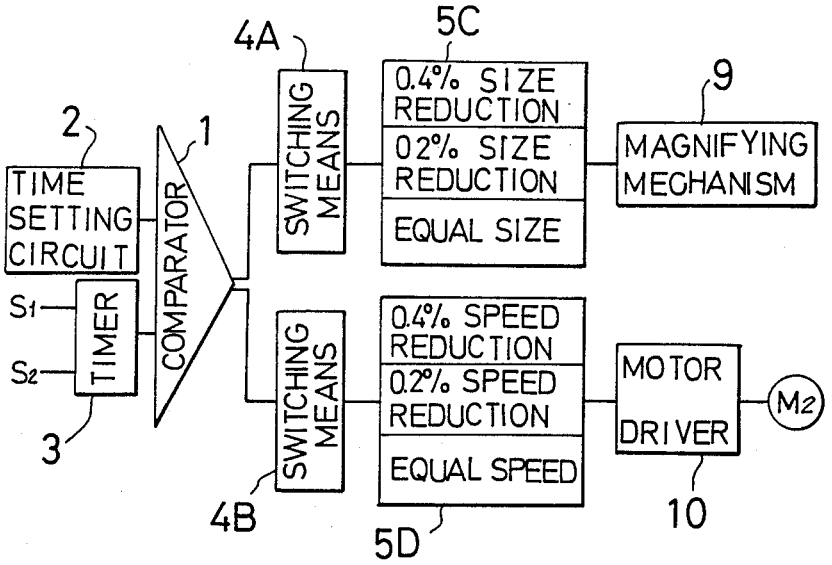
FIG. 4 is a block diagram of a circuit used for carrying out a method according to still another embodiment of the present invention.

FIG. 4 shows a circuit arrangement for carrying out a method according to still another embodiment. This method resides in that the main scanning cycles are reduced in length by changing the magnification of an optical system, and the sub-scanning cycles are varied by changing the speed of rotation of the sub-scanning feed motor for thereby correcting a second image in size.

More specifically, the main scanning switching means 4A is connected to a magnifying mode setting means 5C coupled to a magnifying mechanism 9 for a main scanning optitcal system. The sub-scanning switching means 4B is connected to speed clock generating means 5D coupled to a motor driver 10. The switching means 4A enables the magnifying mode setting means 5C to select a magnifying mode according to the amount of sheet shrinkage. The magnification of the main scanning optical system is varied according to the selected magnifying mode by the magnifying mechanism 9 of a known nature.

The switching means 4B enables the speed clock generating means 5D to select a corrected clock signal which is applied to the motor driver 10. The motor driver 10 reduces the speed of rotation of the sub-scanning feed motor M2 according to the corrected clock signal.

In the illustrated embodiments, the three corrective values: 0.4, 0.2, 0 are employed. However, more switching steps may be used for higher accuracy, or less switching steps may be employed for simpler control.

Where images are recorded in a fixed mode and sheets with recorded images are left in a stable time period, i.e., where double images are recorded in a constant mode or the sheets are left in a very short interval of time, the process of calculating, with the timer, the time in which a sheet is to be left may be dispensed with, and the length of an image to be formed upon re-feeding the sheet may be set to a fixed value dependent on the double image recording mode.

The double image recording method of the invention may be used in a digital copier in which read-out data items are accumulated and converted to digital values when a sheet is exposed to such data items.

Although certain preferred embodiments have been shown and described, it should be understood that many changes and modifications may be made therein without departing from the scope of the appended claims.

What is claimed is:

1. A method of recording double images on a recording medium by recording a first image on the recording medium and then recording a second image on the recording medium with main scanning means for scanning the recording medium in a first direction transverse to a second direction in which the recording medium is moved, and sub-scanning means for moving the recording medium in said second direction, said method comprising the step of:

varying an image magnification dependent on the magnification of an optical system, a main scanning clock signal, and the speed of movement of said main scanning means, or an image magnification dependent on a subscanning clock signal and the speed of movement of said sub-scanning means, or both of said image magnifications between said first and second images.

2. A method according to claim 1, wherein when one or both of the main magnifications in said main scanning and sub-scanning means are varied, the period of time in which the recording medium is left from the time when the recording medium is passed through an image fixing unit to the time the second image starts to be recorded on the recording medium is calcuated on the basis of a signal indicative of the completion f fixing of the first image to the recording medium and a signal indicative of re-feeding of the recording medium for recording the second image.

* * * * *